United States Patent [19]

Monticelli et al.

[11] Patent Number: 4,863,077

[45] Date of Patent: Sep. 5, 1989

[54] AUTOMATIC STRETCHERS OF SLEEVES OF KNITTED GARMENTS AND THE LIKE FOR IRONING MACHINES

[75] Inventors: Ivan Monticelli; Paola Grasselli, both of Albinea, Italy

[73] Assignee: System Sate S.r.l., Reggio Emilia, Italy

[21] Appl. No.: 94,142

[22] Filed: Sep. 8, 1987

[51] Int. Cl.[4] ..... D06F 59/02

[52] U.S. Cl. ..... 223/57

[58] Field of Search ..... 223/57, 61, 69, 70, 223/72, 73, 74

[56] References Cited

U.S. PATENT DOCUMENTS 2,315,690 4/1943 Davis ..... 223/57

FOREIGN PATENT DOCUMENTS 1154785 9/1963 Fed. Rep. of Germany ..... 223/57

2918372 11/1980 Fed. Rep. of Germany ..... 223/69

*Primary Examiner*—Robert R. Mackey

*Attorney, Agent, or Firm*—Bucknam and Archer

[57] ABSTRACT

The invention relates to automatic stretchers of sleeves of knitted garments and the like, for ironing machines. These stretchers are composed of chains (1) having links (12), on one side, shaped with conventional grip teeth (13) and, on the other side, with flat surfaces (14) ending in perpendicular side ledges (15). Another feature is constituted by the fact that the chains have their ends pivoted on slides (2), mobile along the external side edges (3) of an extensible elastic frame (4), and on fixed points (5) included inside carters (6) incorporated in the frame (4). In the carters (6) are included powered cogwheels (8), which engage the chains (1).

3 Claims, 2 Drawing Sheets

AUTOMATIC STRETCHERS OF SLEEVES OF KNITTED GARMENTS AND THE LIKE FOR IRONING MACHINES

FIELD OF THE INVENTION

The present invention consists of automatic stretchers of sleeves of knitted garments and the like, which are applied at the sleeve juncture, to extensible elastic frames with which ironing machines are equipped for the support and stretching of the central parts of the garments.

BACKGROUND OF THE INVENTION

Each of these stretchers comprises a chain, made up of links having the following configuration; on one side, they have the conventional teeth which engage a feed cogwheel, and on the other side, they have a flat surface ending in a perpedicular side ledge, which, when coming into contact with the ledges of the adjacent links, forces the chain to a condition of straight and undeformable rigid alignment, just in one sense, whereas in the opposite sense it may take on the conventional flexible conformations. Each chain has one end pivoted to the external side edges of the elastic frames, whereas the other end is introduced into the same frames, at a tangent to the upper juncture of the shoulders, engages the feed cogwheel and is extended inside the container carter or cover in which is placed the second end pivot. The extension of the chains outside the frame may be adjusted depending on the type, size and length of the sleeves to be ironed.

At present certain devices are known in the literature in this field which are more or less effective or rational. These devices are employed manually or automatically for ironing sleeves of knitted garments and the like on ironing machines. Though these devices have proved to be undoubtedly effective, nonetheless, they do have certain disadvantages.

More specifically, it was noted that the devices with a flexible cable may be easily used to stretch short sleeves of knitted garments but when stretching long sleeves they are not so effective due to the excessive flexibility of the cables. The complementary elastic elements have the disadvantage of having to be inserted manually into the sleeves of the garment, entering through the neck opening. This operation, in the case of many garments, may prove awkward due to the very shape of the opening and, in any case, is burdensome, somewhat imprecise and requires a certain waste of time which tends to slow down production schedules. Lastly, the automatically insertable side devices, though for the most part very effective, have the disadvantage of being costly as regards construction.

SUMMARY OF THE INVENTION

The object of this invention is to eliminate the drawbacks mentioned previously.

The automatic sleeve stretchers of knitted garments and the like according to this invention are composed of chains, the links of which, on one side, present a flat surface ending in a perpendicular side ledge; the ends of the chains being pivoted on slides, mobile along the external, side edges of an extensible elastic frame, and on fixed points comprised inside a carter incorporated in the frame; in the carter being also included the powered cogwheels which engage the chains.

The following advantageous results may be obtained by adopting these technical features. The sleeve stretcher devices form an integral part of and are incorporated in the stretcher frames of the central parts of the garments to be ironed. Their extension may be regulated depending on the type, shape and length of the sleeves to be ironed; the chains, constituting the stretcher devices may take on a flexible configuration just in the sense of their winding, whereas in the opposite direction, they assume a rigid, straight and undeformable conformation which is meant to keep the sleeves perfectly taut during ironing, positioning of the stretcher devices is completely automatic and may be regulated by the control panel of the ironing machine. The automatic stretchers are particularly advantageous from various viewpoints: they may adapt to, adhere to and stretch sleeves of knitted garments regardless of their shape, type or length. Fitting of the stretchers to the sleeves is automatically performed, simply by turning the rotation command knob of the feed cogwheel, in one direction or the other; construction of the stretchers is neither costly nor complicated; use of the above mentioned stretchers permits a considerable time saving; with a consequent increase in the productivity of each ironing machine.

BRIEF DESCRIPTION OF THE DRAWING

The invention is illustrated here below in greater detail, making reference to the enclosed drawing which represents a preferred embodiment, in which.

Figure 1:
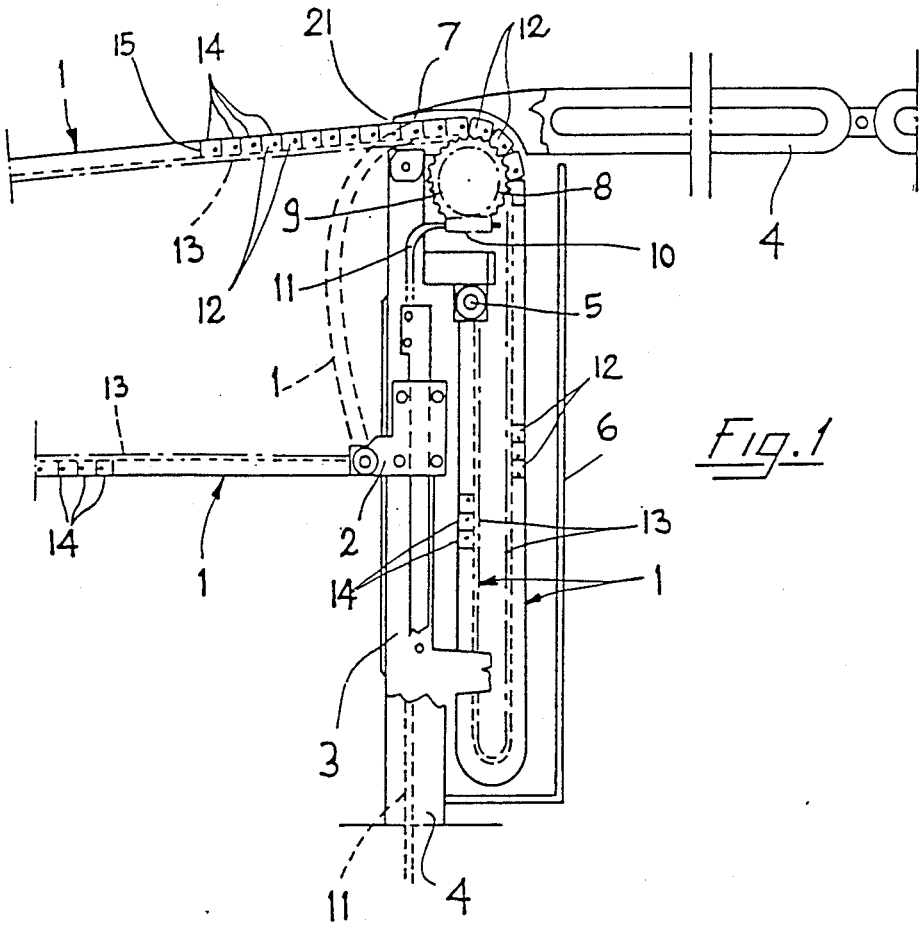
FIG. 1 shows a stretcher applied to one side of an elastic, extensible frame, FIGS. 2 and 2*a* in detail some links of the chain.
Figure 2:
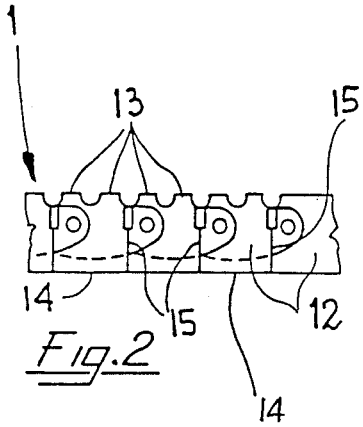
Figure 2A:
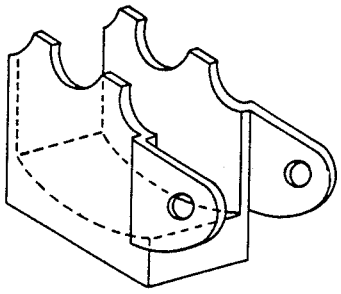
Figure 3:
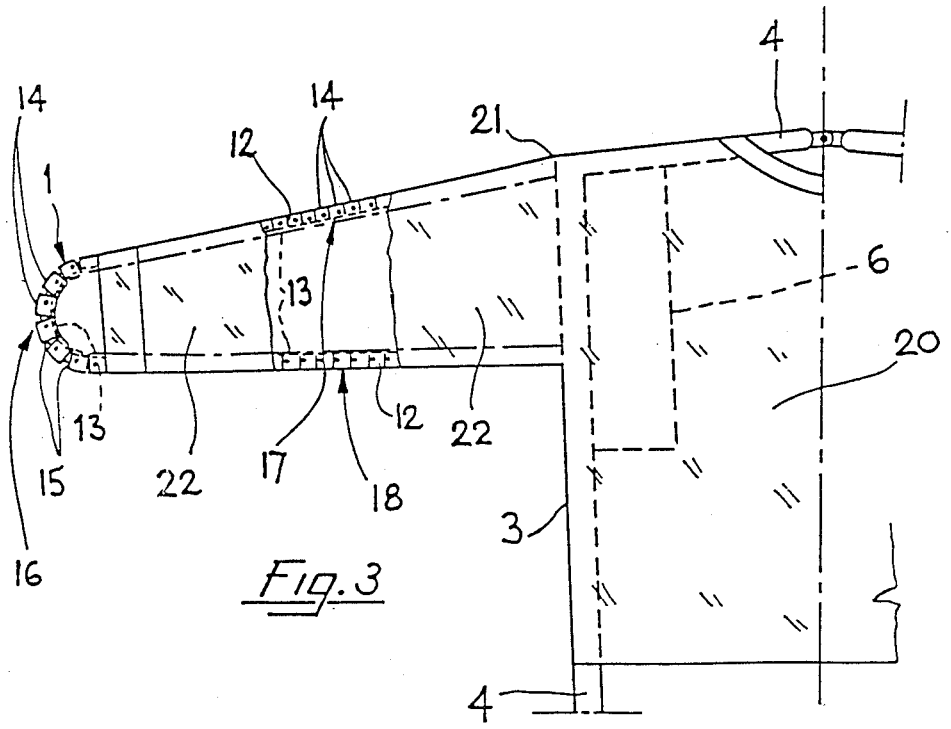
FIG. 3 shows a partial schematic view of a frame, equipped with automatic sleeve stretchers.

The drawings show an automatic sleeve stretcher of knitwear and the like for ironing machines including essentially a chain (1), pivoted, at one end, to a mobile slide (2) along an external side edge (3) of an extensible elastic frame (4), applied to an ironing machine, on which are held and stretched the central parts (20) of the knitted garments.

The other end of the chain (1), on the other hand, is pivoted to a fixed point (5) included inside a container carter (6), incorporated in the frame (4).

From the outside of the carter (6), the chain (1) passes to the inside of same, and vice versa, through an opening (7) made on the upper angle of the frame (4) more or less at the juncture (21) of the garment sleeve. The passage of the chain (1) through the opening is made more or less at a tangent to the shoulder juncture. The control of extension and compression of the chain (1) is carried out by means of a cogwheel (8) coaxial to a helical wheel (9) driven by a worm screw (10). The worm screw (10), in turn, is controlled automatically through a flexible cable (11) connected to a motor (not illustrated).

The cogwheel (8) engages the teeth (13) of the chain (1) in its part immediately inside the frame (4) and the container carter (6). The slide (2) may be moved at will along the outside border (3) of the frame (4) in such a way as to be positioned in the exact desired position depending on the size of the armholes (22) of the garments to be ironed.

At the start of the operation, the two chains (1) constituting the frame stretcher devices (4) are more or less withdrawn inside their frames (4) so as to facilitate insertion over them of the central part (20) of the garment to be ironed. Once the stretching operation of the central part has been completed, the control motors of the flexible cables (11) are set into motion and consequently, the worm screw/helical wheels couple (10 and 9) and the cogwheels (8).

During motion the cogwheels (8) feed the chains (1) which are extended outside the frame (4). However, since the central part (20) of a garment to be ironed is stretched over the frame (4), the chains (1) have to be inserted into the sleeves (22) of the same, in as much as the corresponding armholes are placed between the junctures (21) of the shoulders, i.e. near the openings (7) through which the chains (1) are extended and the position of the slides (2) on which are pivoted the first ends of the chains themselves. The chains (1) are let out slowly until they engage the upper and lower edges of the sleeves (22). The operation of engaging and keeping the sleeves sufficiently taut to permit their ironing is made possible due to the special conformation of the links (12) of the chains (1).

The links (12) are shaped in such a way as to permit bending of the chains just on one side whereas, on the other, they are compelled to keep a rigid, straight and undeformable conformation. This is possible in as much as the links (12) are shaped in such a way that the grip teeth (13) which couple with the cogwheel (8) are present only on their inner sides, whereas the outer sides are composed mainly of a flat surface (14) ending in a perpendicular side ledge (15) which, in conditions of the chain's extension (1), enter into contact with and adhere to the ledges (15) of the adjacent links (12).

When the ledges (15) enter into contact between each other, the chains (1) have to take on, in that direction, a rigid, straight and undeformable conformation.

Due to the fact that the above mentioned sides with flat surfaces (14) are directed towards the outside of the chains (1), the rigid, flat and undeformable conformations take up their position in correspondence with the upper and lower edges of the sleeves (22).

On the other hand, the flexible conformation that the chains (1) may assume towards their inner part, in which the links (12) are provided with teeth (13), permits perfect adjustability of their extension and re-winding, while guaranteeing the end curve configuration (16) which constitutes the limit of the two rigid arms (17 and 18) which are then engaged with the sleeve edges (22).

Once the ironing operation is over, the chains (1) are withdrawn inside the corresponding carters (6), freeing the sleeves (22) thus facilitating removal of the central part (20) from the frame (4).

We claim:

1. An automatic stretcher for an ironing machine for sleeves (22) of knitted garments and the like comprising an extensible elastic frame (4) provided with a cover (6) and a chain (1) for each sleeve, each chain being located on each side of said frame, each chain having links (12), said links having on the interior side, grip teeth (13) and, on the outer side a flat surface (14) ending in a ledge (15) perpendicular thereto; each of said chains (1) having one end pivoted on a slide (2), movable along a side external edge (3) of said extensible elastic frame (4), the other end being pivoted on a fixed point (5) located within said cover (6), a cogwheel (8) engaging each of said chains (1) and means (9,10) for selectively driving each cogwheel, said frame (4) being provided with an opening (7) for each of said chains through which each of said chains is extended, at a tangent to the juncture points (21) of the shoulder of a garment, the adjustment of the position of the slide depending on the type, width and shape of the sleeve (22) of the garment to be ironed.

2. The stretcher according to claim 1 wherein the side of each of the ledges (15), perpendicular to the outer side (14) of the links (12) adheres to the side of the ledges of the adjacent links (12).

3. The stretcher according to claim 1, wherein the means for selectively driving each cogwheel (8) comprises a helical gear and worm screw; a flexible cable (11) for each worm screw and an electric motor for actuating said helical gears and worm screws, said cogwheels providing for the extension and compression of said chains.

* * * * *